US006244001B1

(12) United States Patent
Anastasi

(10) Patent No.: US 6,244,001 B1
(45) Date of Patent: Jun. 12, 2001

(54) FLASHING FOR DOORS AND WINDOWS

(76) Inventor: Leonard L. Anastasi, 25 Heelan Ave., Stoughton, MA (US) 02072

( * ) Notice: Subject to any disclaimer, the term of this patent is extended or adjusted under 35 U.S.C. 154(b) by 0 days.

(21) Appl. No.: 09/516,414

(22) Filed: Mar. 1, 2000

Related U.S. Application Data

(63) Continuation of application No. 09/206,114, filed on Dec. 4, 1998, now abandoned.

(51) Int. Cl.[7] ..... E06B 1/04

(52) U.S. Cl. ..... 52/215; 52/62; 52/211; 52/213; 52/302.6; 52/717.01; 49/504

(58) Field of Search ..... 52/58, 60, 61, 52/62, 209, 211, 215, 213, 302.6, 408, 412, 413, 396.04, 717.01; 49/504, 400, 490.1, 495.1

(56) References Cited

U.S. PATENT DOCUMENTS

| | | | | |
|---|---|---|---|---|
| 1,704,954 | | 3/1929 | Schou . | |
| 2,851,973 | | 9/1958 | Stark et al. . | |
| 3,698,142 | | 10/1972 | Theriault . | |
| 4,391,068 | | 7/1983 | Kosar . | |
| 4,982,530 | * | 1/1991 | Palmer | 49/504 |
| 5,097,641 | | 3/1992 | Hand et al. . | |
| 5,154,029 | * | 10/1992 | Sturgeon | 52/235 |
| 5,230,180 | * | 7/1993 | Tweedt et al. | 49/400 |
| 5,303,523 | | 4/1994 | Hand et al. . | |
| 5,377,464 | * | 1/1995 | Mott et al. | 52/213 |
| 5,551,201 | * | 9/1996 | Anderson | 52/717.05 |
| 5,581,970 | * | 12/1996 | O'Shea | 52/718.01 |
| 5,596,851 | * | 1/1997 | Ting | 52/211 |
| 5,675,939 | | 10/1997 | Hickner . | |
| 5,791,104 | * | 8/1998 | Baier et al. | 52/217 |
| 5,918,427 | | 6/1999 | VanderWerf . | |

* cited by examiner

*Primary Examiner*—Carl D. Friedman
*Assistant Examiner*—Yvonne M. Horton
(74) *Attorney, Agent, or Firm*—Wolf, Greenfield & Sacks, P.C.

(57) ABSTRACT

A system for providing a water proof seal at the interface of a building accessory unit such as a window unit mounted within an opening formed within an exterior wall system. The opening is defined by first and second side jambs, a sill and a head. The exterior wall system has an exterior wall structure and an interior wall structure, and the interior wall structure has an inside wall and an outside wall. In one embodiment, the system comprises first and second unitary flashing members, one connected to each of the jambs. Each of the first and second unitary flashing members comprises a first panel having a width x, a second panel having a width y, and a third panel having a width z. The three panels are connected together along a common edge. The second panel is substantially perpendicular to the first panel, and the third panel is off-set from the first panel and the second panel. The width z, of the third panel measured from the common edge is greater than the width x of the first panel and the width y of the second panel. The first panel of each of the first and second unitary flashing members is engaged with the exterior wall at the first and second side jambs, respectively. The second panels of the first and second unitary flashing members are connected to the interior wall at the first and second side jambs, respectively, and the third panels of the first and second unitary flashing members extend outwardly of the first and second jambs, respectively. In operation, installation of the window unit between the third panels of the first and second unitary flashing members forms a water proof barrier between the window unit and the first and second side jambs.

19 Claims, 2 Drawing Sheets

FLASHING FOR DOORS AND WINDOWS

This application is a continuation of application Ser. No. 09/206,114, filed Dec. 4, 1998, entitled System and Method for Providing a Primary Water Proofing Barrier or Flashing at the Jamb or Framed Opening in an Exterior Wall, and now abandoned.

FIELD OF THE INVENTION

The present invention relates generally to the devices used in the construction industry to prevent water from penetrating into the interior of a structure from the outside environment. More particularly, the present invention relates to devices used in the construction industry to prevent water from penetrating or air from flowing into the interior of a structure at the jambs of a framed opening in an exterior wall system.

BACKGROUND OF THE INVENTION

The construction of a commercial building and/or residential home involves the installation of numerous doors and windows. In recent years, doors and windows are commonly designed as a single unit to facilitate the installation of such units. Conventionally, an exterior wall is constructed with an opening sized to receive the door and/or window unit and caulking is applied around the interface of the wall and/or jamb and the door and/or window unit to prevent moisture and/or water from entering into the interior of the building. Over a period of extended time the seal between the door and/or window unit and the exterior wall created by the caulking deteriorates due to exposure to environmental conditions thereby allowing water and/or moisture to enter into the interior space of the building.

The principal objective of the present invention is to provide a water proof barrier between a window and/or door unit and an exterior wall which will not deteriorate when exposed to adverse weather conditions. Another objective of the present invention is to provide a system which allows a window and/or door unit to be easily installed within an exterior wall while providing a water proof barrier which will not deteriorate when exposed to adverse weather conditions. Another objective of the present invention is to provide an air dam at the jams of the window and/or door jams in order to prevent the flow of air which may or may not carry moisture from the outside environment of the exterior wall system into the interior space of a building.

SUMMARY OF THE INVENTION

The present invention comprises a system for providing a water proof seal and an air dam at the interface of an exterior building accessory unit such as window unit, door unit or storefront mounted within an opening formed in an exterior wall structure of a building. The opening is defined by first and second side jambs, a sill and a head. The exterior wall structure may have an interior wall and an exterior wall. In one embodiment, the system comprises first and second unitary flashing members connected to the first and second side jambs, respectively. Each of the first and second unitary flashing members comprising a first panel having a width x, a second panel having a width y, and a third panel having a width z. The second panel is substantially perpendicular to the first panel, and the third panel is off-set from the first panel and the second panel. The width z of the third panel is greater than the width x of the first panel and the width y of the second panel. In use the first panels of the first and second unitary flashing members are engaged with the exterior walls at the first and second side jambs, respectively. The second panels of the first and second unitary flashing members are connected to the interior wall at the first and second side jambs, respectively. The third panel of each of the first and second unitary flashing members extends outwardly of the first and second jambs, respectively. In operation, installation of the window unit between the third panels of the first and second unitary flashing members forms a water proof barrier between the window unit and the first and second side jambs.

BRIEF DESCRIPTION OF THE DRAWINGS

The following description of the invention will be better understood with reference to the accompanying drawings in which.

DETAILED DESCRIPTION

Figure 1:
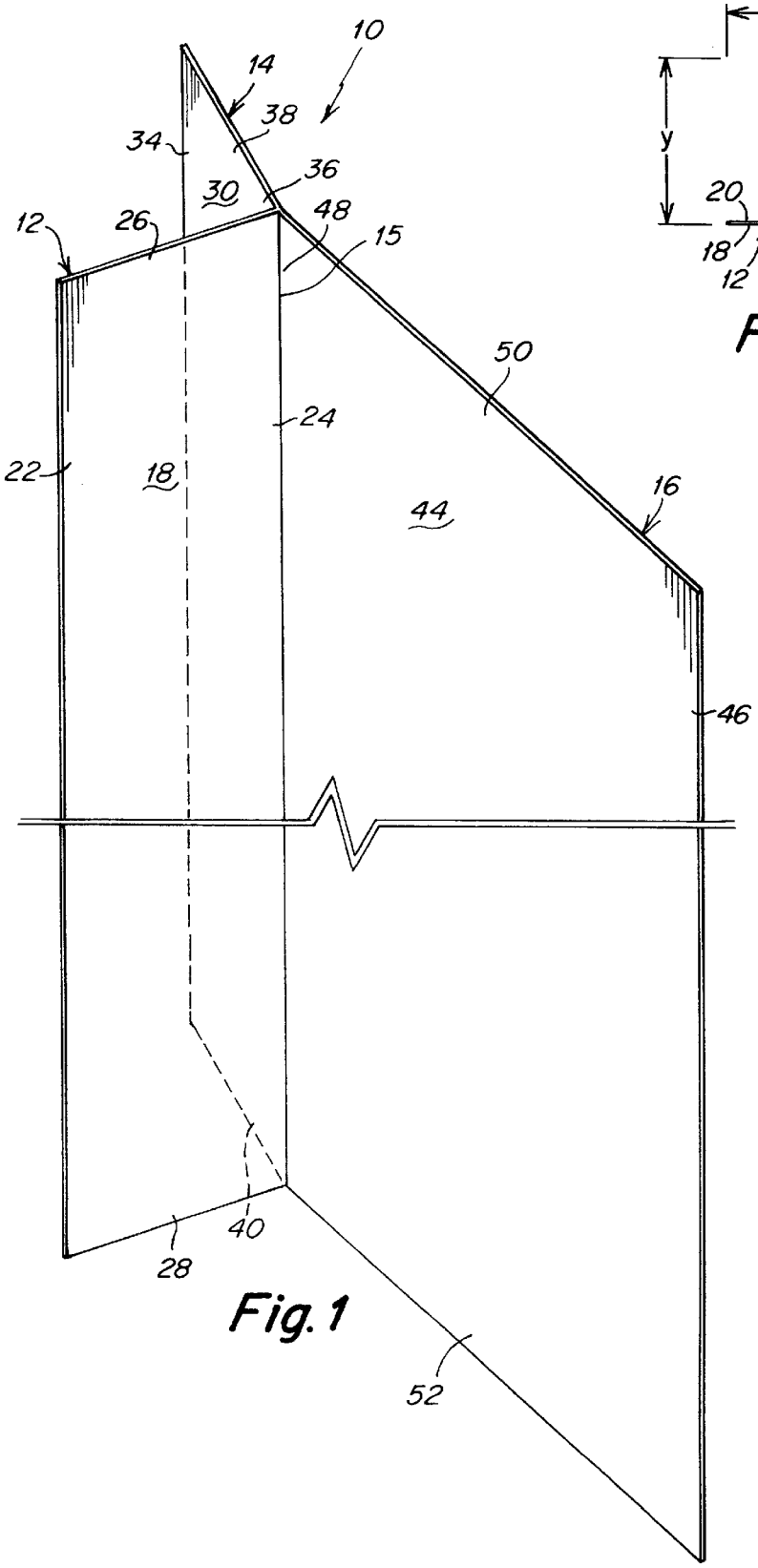
FIG. 1 is a perspective view of the flashing of the present invention.
Figure 2:
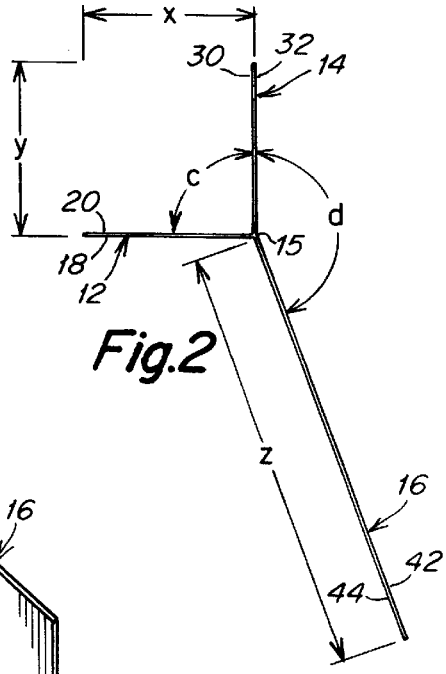
FIG. 2 is a top plan view of the flashing of the present invention.

The present invention is a system and method for providing a primary water proofing barrier or flashing and an air dam at the jambs of a framed opening in an exterior wall and the article and/or accessory mounted therein such as a window unit door unit or storefront. Referring to FIGS. 1 and 2, wherein a first embodiment of the flashing 10 of the present invention is shown generally comprising a first panel 12, a second panel, 14 and a third panel 16. The three panels in the embodiment shown are connected together along a common side edge 15, and the panels radiate outwardly from that edge. The first panel 12 has an inner surface 18, an outer surface 20, a first side portion 22, a second side portion 24, a top end portion 26, a bottom end portion 28 and a width x. The second panel 14 has an inner surface 30, an outer surface 32, a first side portion 34, a second side portion 36, a top end portion 38, a bottom end portion 40, and a width y. The third panel 16 has an inner surface 42, an outer surface 44, a first side portion 46, a second side portion 48, a top end portion 50, and a bottom end portion 52, and a width z. In the preferred embodiment, first panel 12, second panel 14 and third panel 16 are made from a semi-rigid material such as polypropylene and formed as a unitary piece by a conventional molding process. In the preferred embodiment, the width x and y are about three (3) inches while the width z, is about seven (7) inches.

Figure 3:
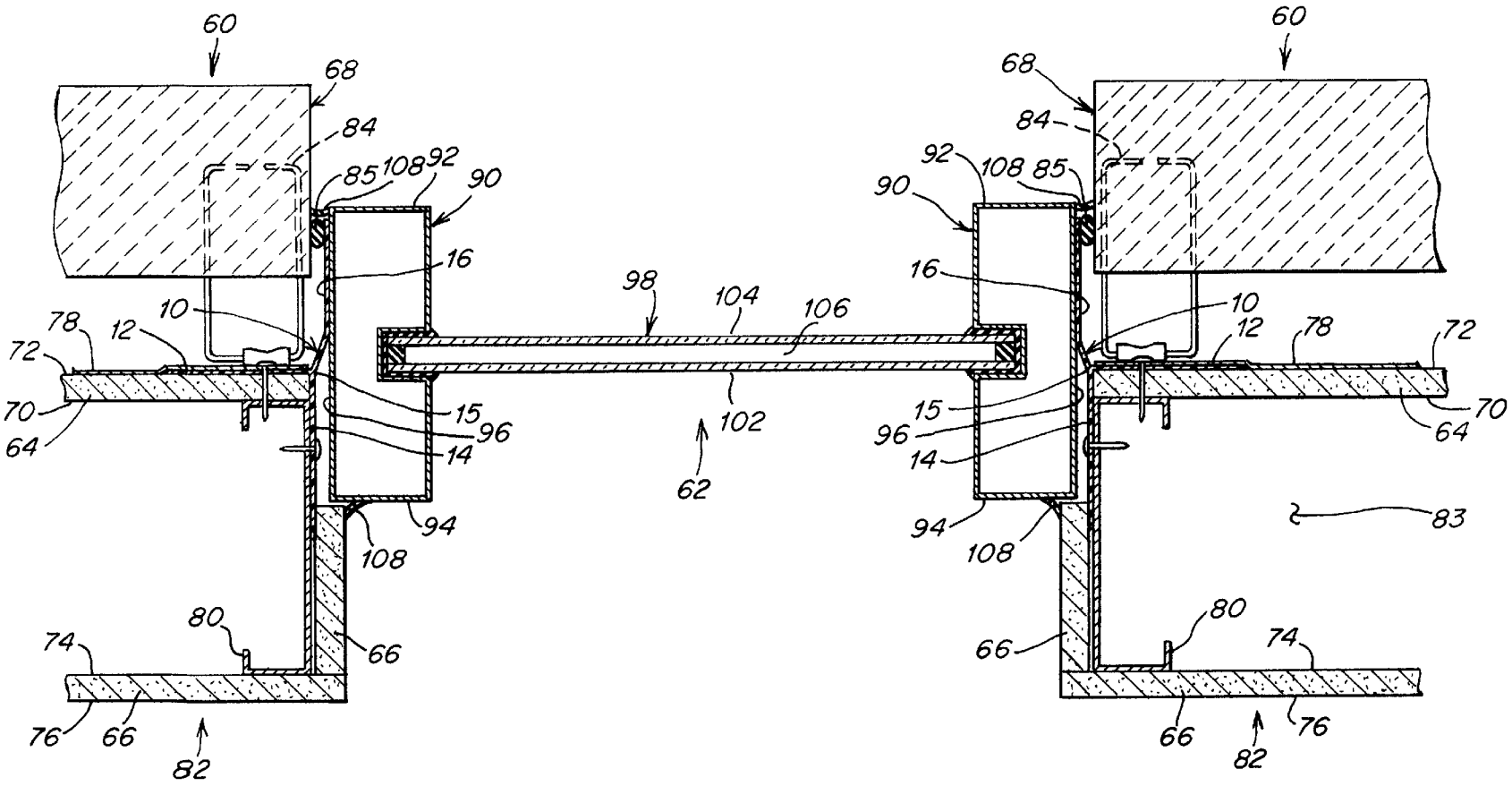
FIG. 3 is a cross-sectional view showing the flashing of the present invention operatively engaged with a window system disposed in an exterior wall structure.

Referring to FIG. 3, wherein the flashing 10 is shown in connection with the framed opening of a wall system 60 and a window system 62. The wall system 60 generally comprises an exterior wall structure 68 composed of an exterior finish material such as face brick. The wall system 60 further comprises an interior wall structure 82 which generally comprises an inside wall 66 and an outside wall 64 made from conventional materials such as sheet rock. The inside wall 66 and the outside wall 64 are generally composed of framing materials and sheathing materials. The outside wall 64 has an inside surface 70 and an outside surface 72. The inside wall 66 has an inside surface 74 and an outside surface 76. The wall system 60 further comprises a moisture barrier 78 designed to entrap moisture that may penetrate the exterior wall structure 64 and prevent the same from penetrating the outside wall 64. The inside and outside walls 66 and 64 are mounted by studs or framing 80 that create an open space 83 in the interior wall structure 82 which may or may not be filled with insulation. The exterior wall structure 68 is attached to the interior wall structure 82 by conventional means such as veneer anchors. The system 10 further comprises a sealant system 85 such as a preformed caulking and backer rod that is adhered to the exterior wall structure 68 and, in the use illustrated, the window system 62.

The window system 62 generally comprises a window frame 90 having an outside surface 92, an inside surface 94, and a side surface 96. The window system 62 further comprises a glass structure 98 mounted within the window frame 90. In the embodiment shown, the glass structure 98 comprises two sheets of glass 102 and 104 separated to create an insulating air pocket 106.

The flashing 10 is mounted to the wall system 60 in a variety of ways. In the embodiment shown, the first panel 12 of the flashing 10 may be attached to the outside surface 72 of the outside wall 64 by conventional means such as screws (not shown). The second panel 14 of the flashing 10 is attached to the inside surface 74 of inside wall 66 by conventional means such as screws (not shown). The third panel 16 of the flashing 10 extends outwardly of the outside wall 64 of interior wall structure 82 and is adapted to receive and engage with the side surface 96 of the window frame 90. Engagement of the window frame 90 and the third panel 16 of the flashing 10 causes the third panel 16 to elastically deflect inward against the sealant system 85 and apply a constant force to the window frame 98. A caulking material 108 is applied along the interface of the window frame 92, third panel 16, sealant system 85, and face brick 68.

Use of the flashing 10 in the manner described creates a primary water and air seal and/or barrier between the window frame 90 and the face brick 68 preventing any water from entering into the interior wall space 82 from the outside environment.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those skilled in the art.

What is claimed is:

1. A system for providing a waterproof barrier and air seal at the interface of an accessory unit and a wall system in which the unit is mounted comprising, a wall system having inside and outside walls and an opening having side jambs in the system through the inside and outside walls for receiving the accessory unit, an accessory unit disposed in the opening and having a frame in closely spaced relation with the jambs, and a unitary, semi-rigid flashing member, one on each side of the frame, and connected to the wall system and accessory unit for forming the waterproof barrier and air seal, each flashing member including a first panel connected to the inside wall and a second panel disposed between the jamb and frame and being elastically deflected by the frame toward the jamb.

2. A system as defined in claim 1 wherein each flashing member includes a third panel also connected to the inside wall.

3. A system as defined in claim 1 wherein the flashing member is made of a plastic material.

4. A system as defined in claim 1 wherein the width of the first named panel is less than the width of the second panel.

5. A system as defined in claim 2 wherein the three panels are connected together along a common edge.

6. A system as defined in claim 5 wherein the width of the second panel measured perpendicular to the common edge is greater than the widths of the first named and third panels also measured perpendicular to said edge.

7. A system as defined in claim 1 wherein the accessory unit is a door assembly.

8. A system as defined in claim 1 wherein the accessory unit is a window assembly.

9. A system as defined in claim 1 wherein the panels are integrally molded as a unitary structure from a plastic material and with the third panel having an unstressed biased position.

10. A system as defined in claim 9, wherein the third panel is deflected from its biased position by the frame pressed against it.

11. A system for providing a waterproof barrier and air seal at the interface of an accessory unit and a wall system in which the unit is mounted comprising, a wall system having a wall and an opening therein defined by a plurality of sides for receiving the accessory unit, an accessory unit disposed in the opening and having a frame in closely spaced relation with sides of the opening, and a flashing member, connected to the wall system and engaging the frame of the accessory unit for forming the waterproof barrier and air seal, the flashing unit including first and second panels separately connected to the wall system, and a third panel connected to the first and second panels and bearing against and elastically deflected by the frame toward the side of the opening.

12. A system as defined in claim 11 wherein the panels are integrally molded as a unitary structure from a plastic material and with the third panel having an unstressed biased position.

13. A system as defined in claim 12 wherein the third panel is deflected from its biased position by the frame pressed against it.

14. A system as defined in claim 11 wherein the accessory unit is a door assembly.

15. A system as defined in claim 11 wherein the accessory unit is a window assembly.

16. A system as defined in claim 11 wherein the width of the first and second planes is approximately 3 inches.

17. A system as defined in claim 16 wherein the width of the third plane is approximately 7 inches.

18. A method of forming a waterproof seal about at least a portion of the frame of a window Or door mounted in an opening in a wall, said opening being defined in part by a jamb, including the steps of providing a flashing member having semi-rigid panels connected together at a common edge so that they generally radiate outwardly from that edge, connecting one of the panels to the jamb, and operatively connecting another of the panels to the frame by elastically deflecting it by the frame toward the jamb.

19. A system for providing a waterproof barrier and air seal at the interface of an accessory unit and a wall system in which the unit is mounted comprising, a wall system having a wall and an opening therein for receiving the accessory unit, an accessory unit disposed in the opening and having a frame in closely spaced relation with the margins of the opening, and a flashing member and connected to the wall system and accessory unit for forming the waterproof barrier and air seal, each flashing unit including first and second panels connected together along a common edge, said first and second panels each separately connected to the wall system at the margin of the opening in substantially perpendicular planes, and a third elastically deflectable panel connected to the first and second panels and bearing against the frame in a deflected position.

* * * * *